US007963893B1

(12) United States Patent
Cruz et al.

(10) Patent No.: US 7,963,893 B1
(45) Date of Patent: Jun. 21, 2011

(54) METHOD OF PRE-TENSIONING A RESISTANCE EXERCISE BAND

(76) Inventors: Christian Cruz, Key West, FL (US); Jerrold Pine, Boca Raton, FL (US)

( * ) Notice: Subject to any disclaimer, the term of this patent is extended or adjusted under 35 U.S.C. 154(b) by 0 days.

(21) Appl. No.: 12/757,022

(22) Filed: Apr. 8, 2010

Related U.S. Application Data

(62) Division of application No. 12/113,933, filed on May 1, 2008, now Pat. No. 7,695,413.

(60) Provisional application No. 60/972,189, filed on Sep. 13, 2007, provisional application No. 60/951,954, filed on Jul. 26, 2007, provisional application No. 60/917,310, filed on May 10, 2007.

(51) Int. Cl.
*A63B 21/02* (2006.01)

(52) U.S. Cl. ..... 482/126

(58) Field of Classification Search ..... 482/121–130, 482/140, 91, 907–908, 139, 51, 148
See application file for complete search history.

(56) References Cited

U.S. PATENT DOCUMENTS 3,345,067 A 10/1967 Smtih
5,484,368 A * 1/1996 Chang ..... 482/122
7,238,144 B2 7/2007 Ferrara

* cited by examiner

*Primary Examiner* — Lori Baker
(74) *Attorney, Agent, or Firm* — Allen D. Hertz

(57) ABSTRACT

An elastic resistance band that is fabricated by placing two end couplers on each end of a section of elastic resistance material. A pre-tensioned force is applied by incorporating a rigid tensioning member between the two end couplers of the resistance band. The resistance material is stretched during the assembly process, placing the material in a pre-tensioned state. By pre-tensioning the material, the resistance band then provides a more linear force to the end user.

20 Claims, 12 Drawing Sheets

METHOD OF PRE-TENSIONING A RESISTANCE EXERCISE BAND

RELATED US PATENT APPLICATIONS

This is a Divisional Application of Non-Provisional application Ser. No. 12/113,933 filed on May 1, 2008 and issuing as U.S. Pat. No. 7,695,413 on Apr. 13, 2010, which claims the benefit of Provisional Application 60/917,310 filed on May 10, 2007, Provisional Application 60/951,954 filed on Jul. 26, 2007, and Provisional Application 60/972,189 filed on Sep. 13, 2007, all of which are incorporated by reference herein.

FIELD OF THE INVENTION

The invention relates to a resistance exercise band, more specifically, a resistance exercise band that provides a linear force curve.

BACKGROUND OF THE INVENTION

Exercise is a task that people should endure on a regular basis. With people's busy schedules, any simplification to the exercise routines aids helps entice people to exercise.

Resistance exercise bands provide a user the ability to exercise using a resistive load (force) without the requirement of heavy weights. Resistance exercise bands are typically stretched between two points to simulate dead weights' resistance. They are used across the complete spectrum of exercises to provide resistance while doing curls, bench pressing, butterfly's, leg presses and many other exercises. One such advantage of resistance bands would be for a person who travels. Another such advantage of resistance bands would be the cost and weight of an exercise machine when compared to those utilizing lead (or other) weights. Another such advantage is the cost effectiveness compared to a gym membership. Yet, another advantage is the convenience of resistance bands, wherein the user can exercise quickly, easily and wherever desired.

Currently available elastic resistance bands are tubular with a cylindrical cross section having a hollow center section. To provide a variety of resistive ranges, current elastic resistance bands have various cross sections with varying outer diameters, wall thickness, and inner diameters coupled with different rubber durameters.

Typical elastic resistance bands generate a non-linear resistive force whose unit force/distance changes dramatically as the band is elongated. The resulting force distance curve provides regions where the net work and feel of the resistance differs dramatically from exercising with free weights.

What is desired is a means for providing a user the ability to replicate the feel and net workout from exercising with free weights, while using resistance exercise bands.

SUMMARY OF THE PRESENT INVENTION

A first aspect of the present invention is a resistance exercise band, which provides a linear resistance curve.

Yet, another aspect is an elastic resistance band comprising a rigid material placed between two connecting ends of the elastic resistance band.

Yet, another aspect is an elastic resistance band comprising a rigid material placed between two connecting ends of the elastic resistance band, wherein the resistance band material is placed into a pre-tensioned state.

Yet, another aspect is an elastic resistance band comprising a rigid material placed between two connecting ends of the elastic resistance band, wherein the resistance band material is placed into a pre-tensioned state, applying a force against a force receiving member located on each opposing end of the elastic resistance band material.

Yet, another aspect is a force receiving member located at least partially internal to the elastic resistance band and at each opposing end of the elastic resistance band material.

Yet, another aspect is a force receiving member located at least partially external to the elastic resistance band and at each opposing end of the elastic resistance band material.

Yet, another aspect is an elastic resistance band comprising a material placed in a center of a hollow, cylindrical elastic resistance band cross section, wherein said material placed in said center is a non-compressible solid material.

Yet, another aspect is an elastic resistance band placing the cylindrical elastic resistance band material within a tubular, non-compressible solid material.

Yet, another aspect utilizes a non-elastic member consisting of two end points, each end point fixed at the respected end of a section of the elastic resistance band.

Yet, another aspect utilizes a non-elastic member that is longer than the respected section of the elastic resistance band.

Yet, another aspect utilizes a plurality of sections of elastic resistance band material; the plurality of sections being coupled in series or end to end.

Yet, another aspect utilizes a plurality of sections of elastic resistance band material; the plurality of sections being coupled in parallel.

Yet, another aspect utilizes a plurality of sections of elastic resistance band material; at least one end comprising a band coupling loop.

Yet, another aspect utilizes a plurality of sections of elastic resistance band material; both ends comprising the band coupling loop.

Yet, another aspect provides an embodiment of an elastic resistance band having a handle at each of the opposing ends.

Yet, another aspect provides an embodiment of an elastic resistance band having a handle at a first end and at least one fastening feature at an opposing end.

Yet, another aspect provides an embodiment of an elastic resistance band having a handle at a first end and two fastening features at an opposing end.

Yet, another aspect provides fastening features that are J hooks.

Yet, another aspect provides fastening features that are spring locking clips.

Yet, another aspect provides an embodiment utilizing a non-elastic belting material comprising a plurality of fastening feature coupling members distributed at least partially along the length of the belting material.

Yet, another aspect provides an embodiment utilizing a non-elastic belting material comprising at least two rows of fastening feature coupling members distributed at least partially along the length of the belting material.

Yet, another aspect provides an embodiment incorporating a working loop into the non-elastic belting material wherein the user can secure the working loop around the user's foot, a door, or other object.

Yet, another aspect provides an embodiment of an elastic resistance band having a handle at a first end and plurality of flanges or rings distributed towards the opposing end of the elastic resistance band.

Yet, another aspect utilizes at least one of a split ring, a carbineer, a spring sleeve, a spring clip, and the like for coupling at least two pre-tensioned resistance band assemblies.

BRIEF DESCRIPTION OF THE DRAWINGS

For the purpose of initially illustrating the invention, the specification presents drawings, flow diagrams, and embodiments that are presently preferred as well as alternates. It should be understood, however, that the invention is not limited to the specific instrumentality and methods disclosed herein. It can be recognized that the figures represent a layout in which persons skilled in the art may make variations therein. In the drawings.

Like reference numerals refer to like parts throughout the several views of the drawings.

DETAILED DESCRIPTION OF THE DRAWING

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
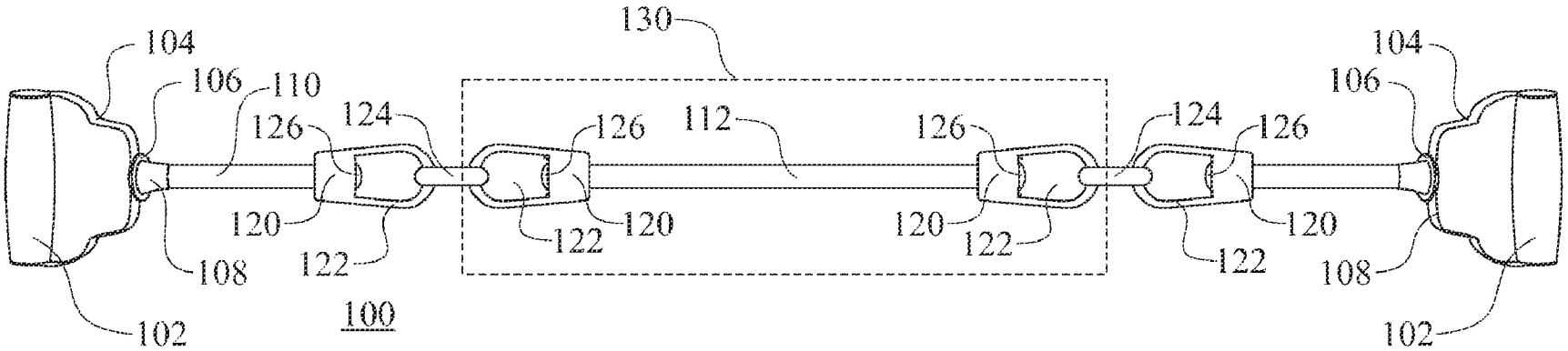
FIG. 1 illustrates a side view of a linear resistance exercise band.
Figure 2:
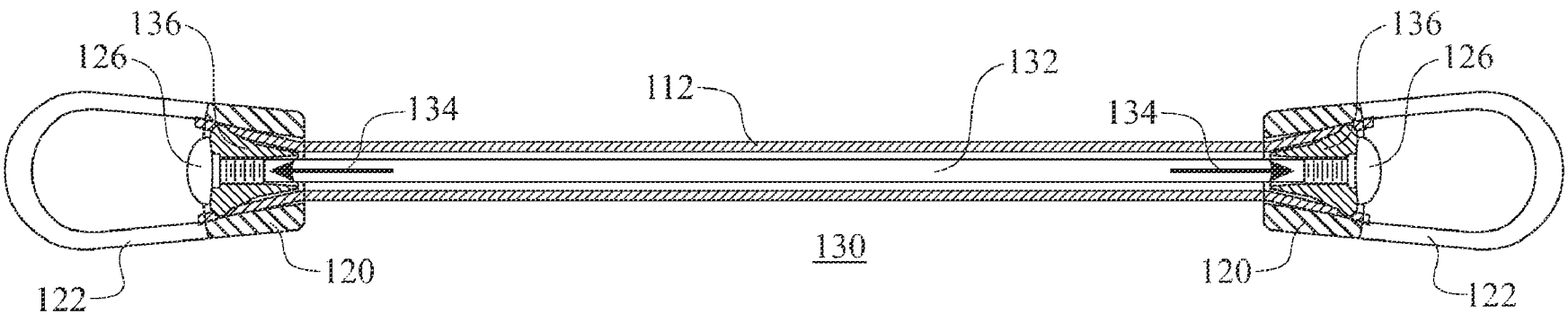
FIG. 2 illustrates a cross sectional view of said linear resistance exercise band through the centerline of the band.
Figure 3:
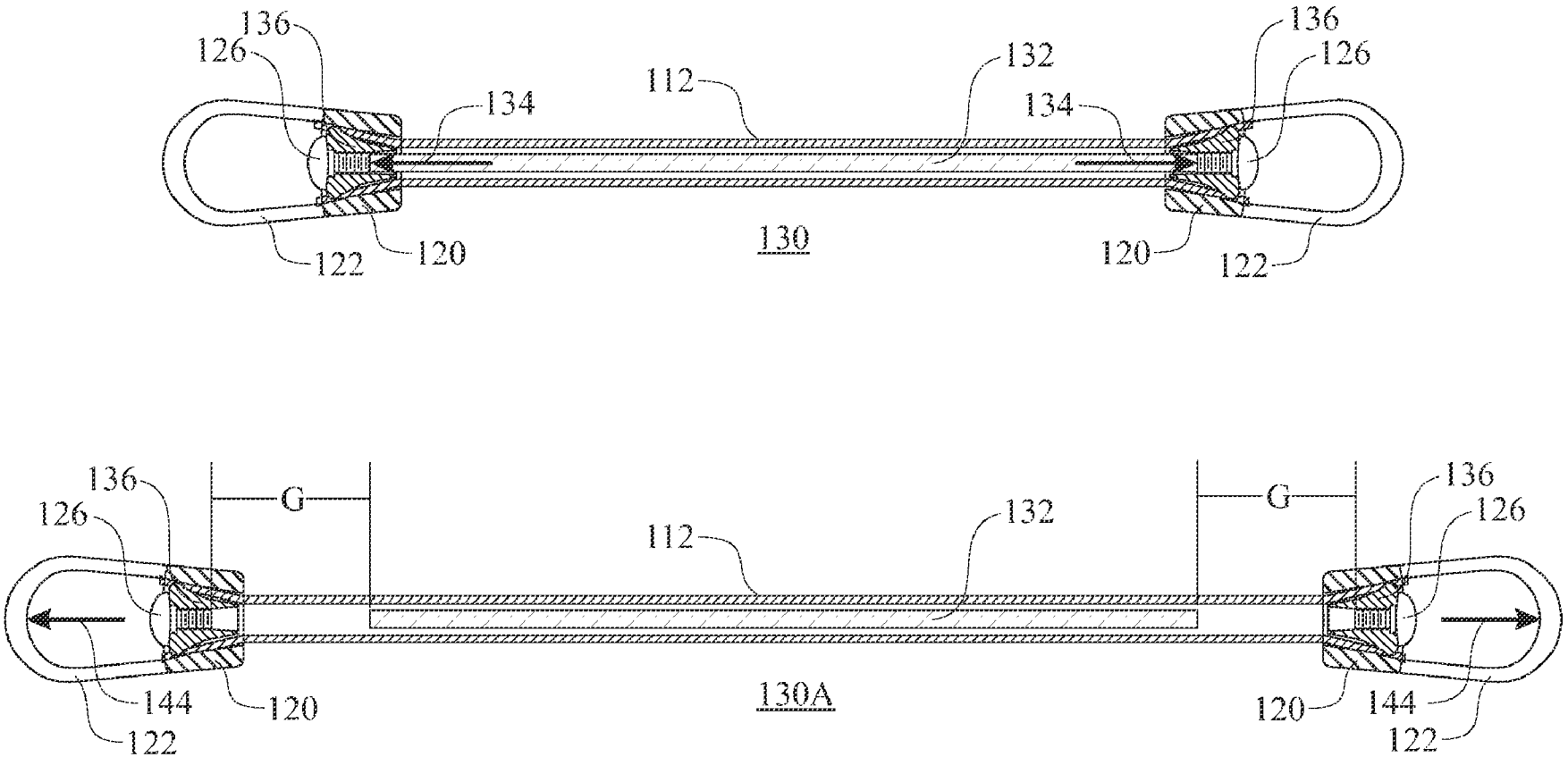
FIG. 3 illustrates a cross sectional view of said linear resistance exercise band through the centerline of the band presenting the band in both a normal state and a stretched state.
Figure 4:
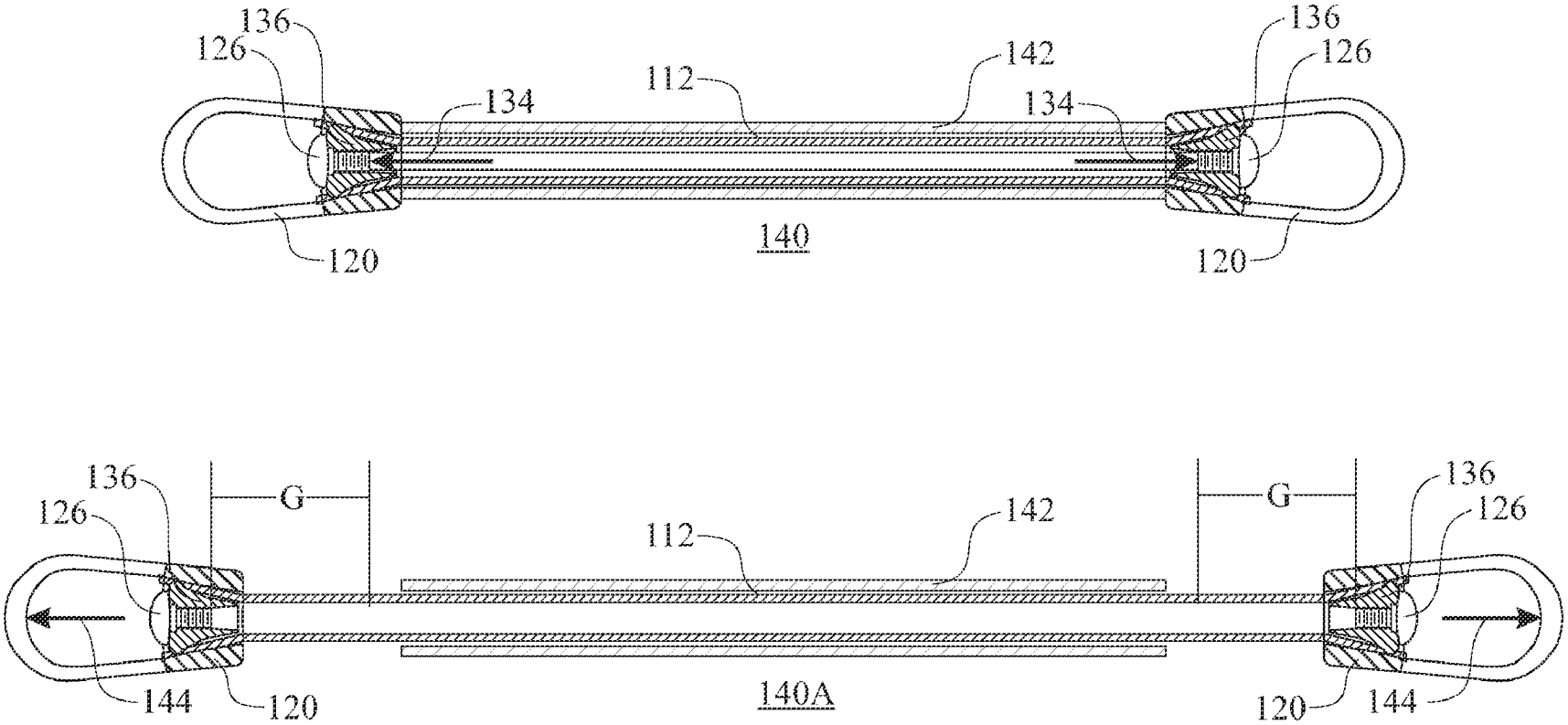
FIG. 4 illustrates a cross sectional view of said linear resistance exercise band utilizing an externally assembled rigid pre-tensioning member, presenting the band in both a normal state and a stretched state.

FIGS. 1 through 4 present a linear resistance exercise band 100. FIG. 1 presents the complete linear resistance exercise band 100. FIG. 2 presents a sectional view about the centerline of a pre-tensioned resistance band assembly 130. FIG. 3 presents the section of pre-tensioned resistance band assembly 130 shown in a relaxed state and pre-tensioned resistance band assembly 130A shown in an expanded state. FIG. 4 presents an alternate embodiment of the linear resistance exercise band, utilizing externally assembled external tension tube 142; presents a section of externally supported pre-tension resistance band assembly 140 shown in a relaxed state and externally supported pre-tension resistance band assembly 140A shown in an expanded state.

The linear elastic resistance band 100 consists of at least one band handle 102 assembled to the linear elastic resistance band 100 via a band handle strap 104 and a band handle fastener 108. The handle assembly can be reinforced via the inclusion of a band handle reinforcement 106. The handle assembly can be secured to a first end of a section of non-linear band section 110. A band coupling member 120 is secured to the opposing end of the section of non-linear band section 110. The band coupling member 120 can be of any shape and design determined acceptable by the designer. In the exemplary embodiment, the band coupling member 120 includes a band coupling loop 122 providing the user with a feature for coupling a plurality of elastic band sections. In the exemplary embodiment, the band coupling member 120, the band coupling member 120 has a tapered internal cavity for receiving a tension plug 126. The elastic band material would be placed between the cavity within the band coupling member 120 and the tension plug 126, preferably folded in a manner that doubles the thickness of the elastic material. A tension plug 126 is placed in the end of the band assembly plug 136 as a mechanism for receiving forces applied by a tension rod 132. In an alternate embodiment, the tension rod 132 (which is placed within a hollowed section of the linear elastic band section 112) is replaced by an external tension tube 142. The external tension tube 142 is tubular in shape allowing the linear elastic band section 112 to be placed within a hollowed section of the external tension tube 142. The external tension tube 142 would abut the respective end of each band coupling member 120. This allows the elastic band section 112 to be of a solid material, including rubber, silicone, and composites such as a bungee cord. During assembly, the linear elastic band section 112 would be stretched, utilizing the tension rod 132 or external tension tube 142 presetting a tension generating force 134 to the linear elastic band section 112. The band section 130, 140 would be stretched as stretched band 130A, 140A by applying a tension force 144. The elastic band material has a force—distance curve that includes an inflection point, where the slope changes. The present invention utilizes that property and applies a pre-set tension to the material. The tension takes the material to the inflection point; thus, any additional stretch is found to be linear.

Figure 5:
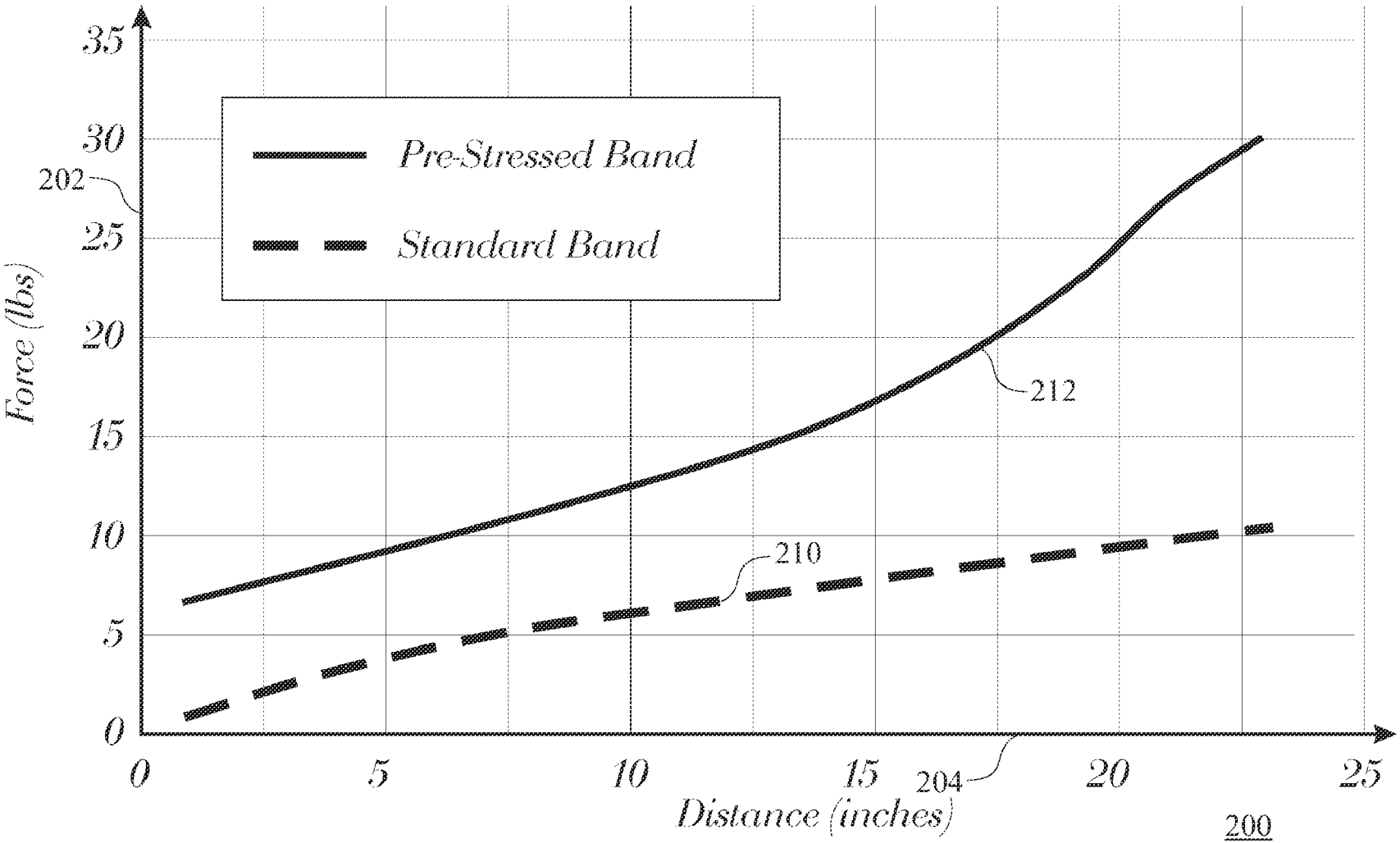
FIG. 5 illustrates a Force-Distance chart comparing a standard exercise band to a linear resistance exercise band.

FIG. 5 presents a Force—Distance chart 200. The Force—Distance chart 200 charts a force axis 202 vs. a distance axis 204. The resistive force provided by the band is charted along the force axis 202. The total distance in which the band is stretch is charted along the distance axis 204. The standard band is characterized via a standard resistance band curve 210. The pre-stressed band is characterized via a pre-stressed resistance band curve 212. The area under each respective curve is equal to the work performed for each repetition while exercising. The work performed by pre-stressed resistance band curve 212 is double the work performed by standard resistance band curve 210. The area under the curve for pre-stressed resistance band curve 212 represents the equivalent workout and approximate feel of an exercise using a 15 lb free weight.

Figure 6:
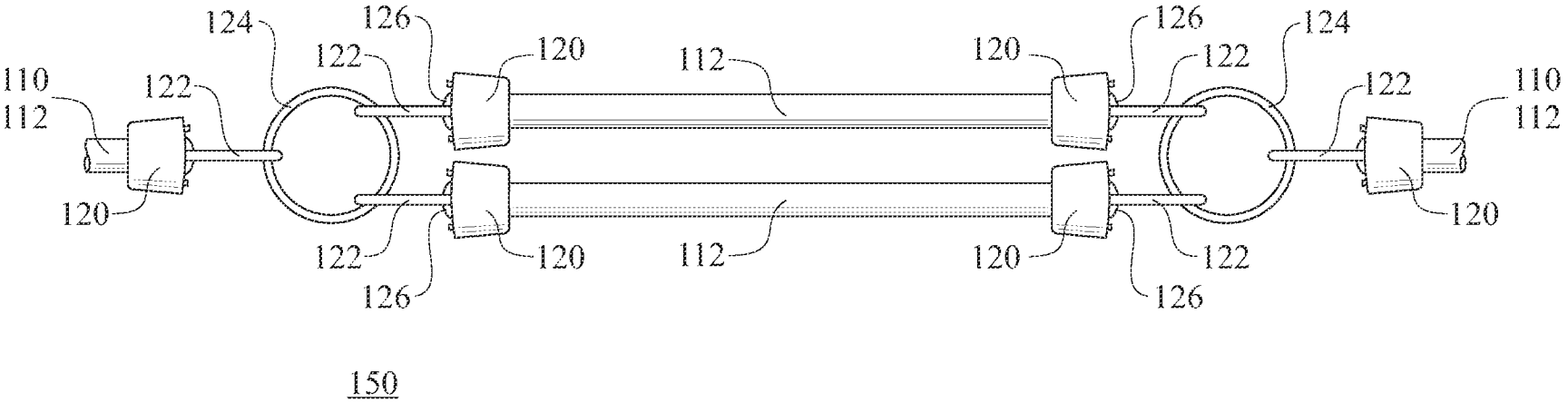
FIG. 6 illustrates a side view of a serial linear resistance exercise band configuration.
Figure 7:
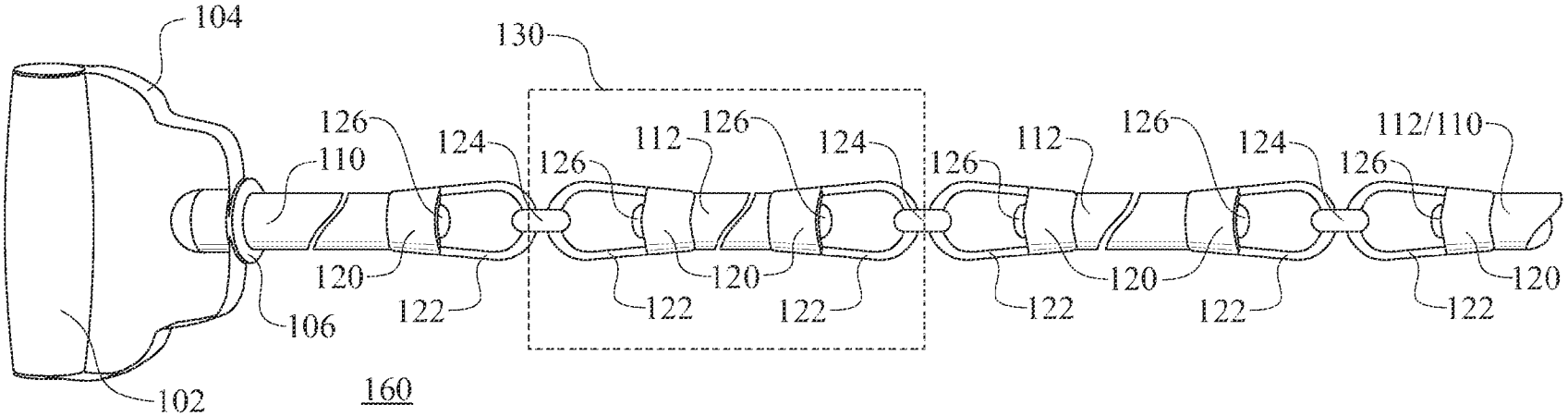
FIG. 7 illustrates a side view of a person using the linear resistance exercise band.

FIGS. 6 and 7 present two embodiments for use of the pre-tensioned resistance band assembly 130; a parallel arranged pre-tensioned elastic resistance assembly 150 coupling a plurality of pre-tensioned resistance band assembly 130 in parallel and a serially arranged pre-tensioned elastic resistance assembly 160 coupling a plurality of pre-tensioned resistance band assembly 130 in series. The parallel arranged pre-tensioned elastic resistance assembly 150 doubles the net work performed during each exercise repetition by doubling the resistive force per unit distance elongated. The serially arranged pre-tensioned elastic resistance assembly 160 doubles the net work performed during each exercise repetition by doubling the total distance elongated. By adding multiple parallel bands of pre-tensioned resistance band assembly 130 you can set the resistance value desired for the each particular exercise. The parallel arranged pre-tensioned elastic resistance assembly 150 couples to pre-tensioned resistance band assembly 130 in a parallel configuration, coupling each of the two ends together via the connecting ring 124. An elastic band 110,112 is then coupled to each connecting ring 124 and oriented projecting away from the parallel arranged pre-tensioned elastic resistance assembly 150. It would be preferred that the length of each of the pre-tensioned resistance band assembly 130 located in parallel would be the same length. Should the plurality of pre-tensioned resistance band assembly 130 differ in length, it is recognized that a compensating coupling device can be utilized. The serially arranged pre-tensioned elastic resistance assembly 160 couples to pre-tensioned resistance band assembly 130 in a serial configuration, coupling each band pre-tensioned resistance band assembly 130 end to end via the connecting ring 124. It is also recognized that the two configurations can be combined within a single exercise band 100. By combining the various form factors of the elastic resistance material, one can "tune" the overall exercise. One can combine several pre-tensioned resistance band assemblies 130, each having a different resistance, or combine a pre-tensioned resistance band assembly 130 with a non pre-tensioned resistance band 112, and the like.

Figure 8:
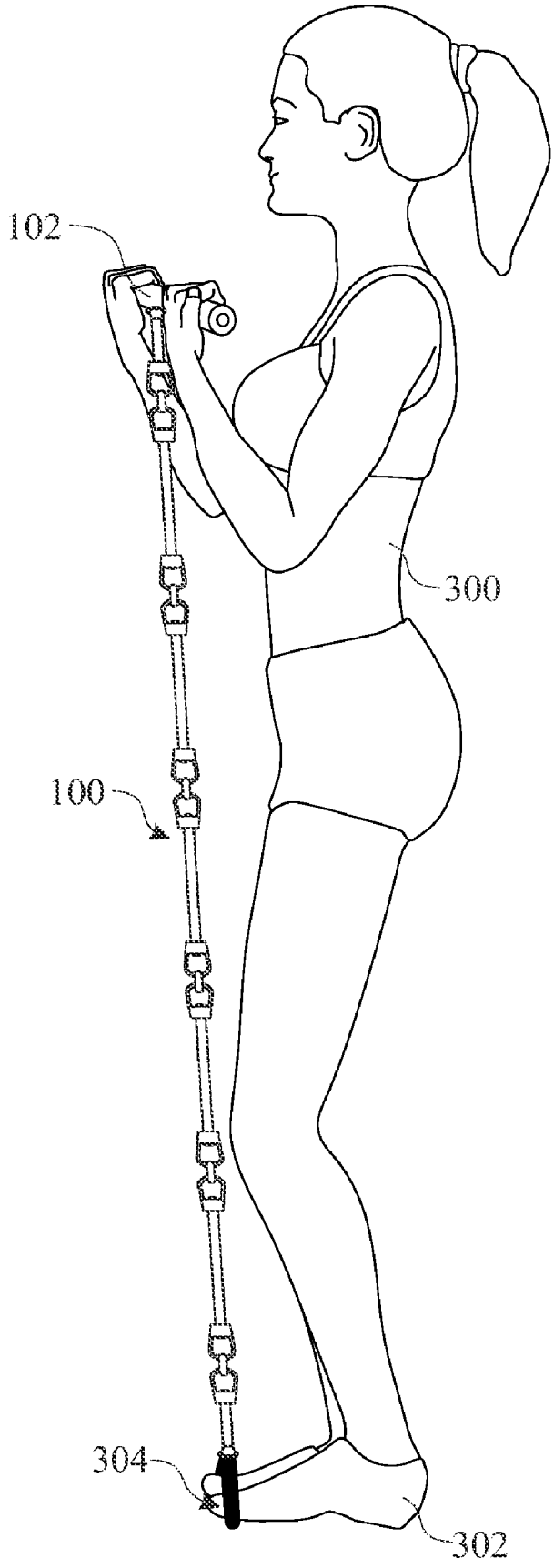
FIG. 8 illustrates a side view of a person using a mechanical exercise station incorporating linear resistance exercise bands.

FIG. 8 presents a user 300 exercising with the linear elastic resistance band 100. The user 300 holds the band handle 102 of the linear elastic resistance band 100 and secures the opposite end by placing their user's foot 302 through a foot interface 304.

Figure 9:
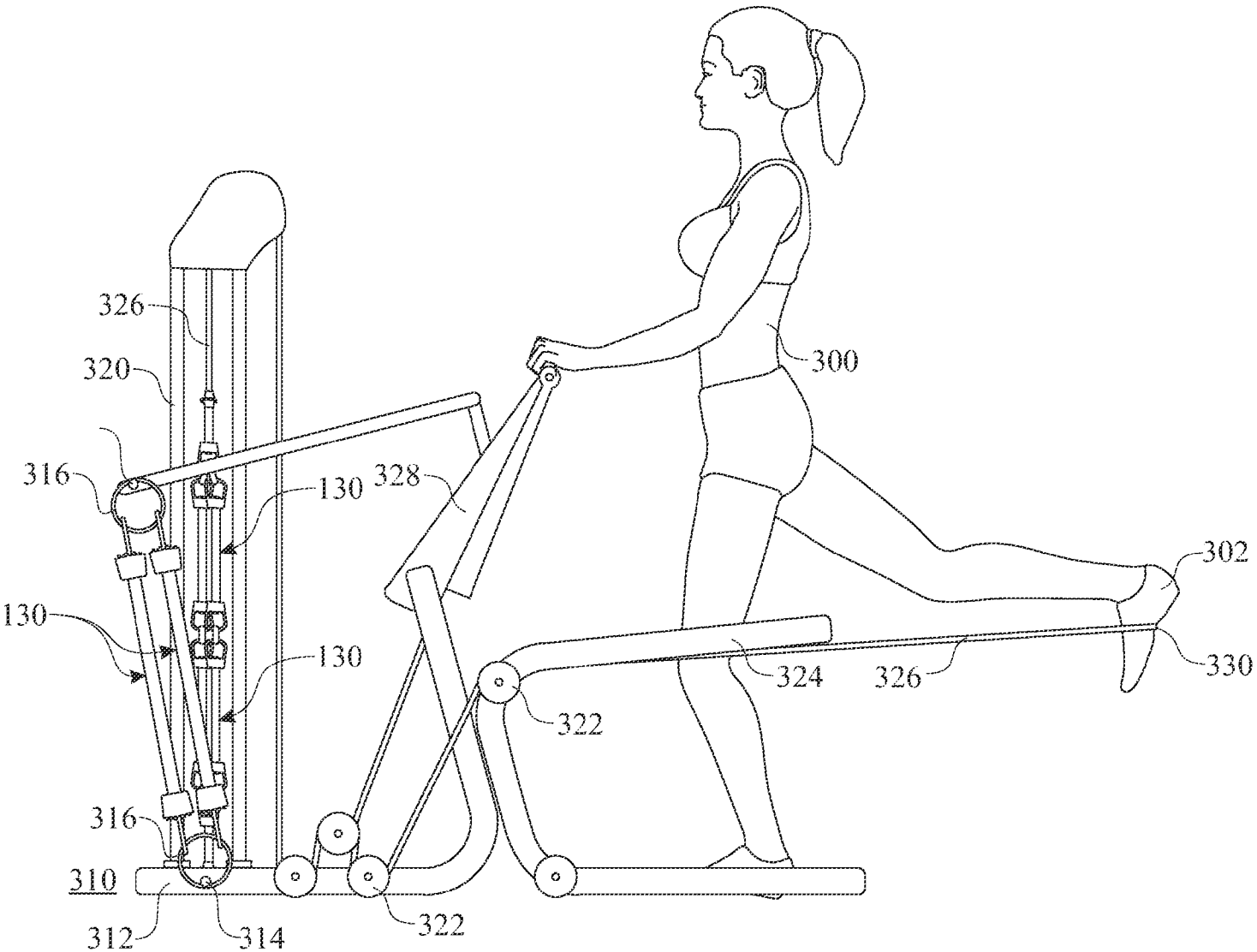
FIG. 9 illustrates a person using said resistance exercise band coupling footwear in accordance with an exemplary embodiment of the present invention.

FIG. 9 presents a user 300 exercising with a resistance operated exercise station 310; the resistance operated exercise station 310 utilizing a plurality of pre-tensioned resistance band assembly 130 to provide the resistance forces. The pre-tensioned resistance band assembly 130 can be utilized for both upper body and lower body workouts. A pair of pre-tensioned resistance band assembly 130 is fastened via a band coupling ring 316 at each end, to a respective resistance band attachment member 314. The resistance force is conveyed to an upper body exercise station 328 for the user's upper body exercises. Additional sections of pre-tensioned resistance band assembly 130 are integrated into a pulley system, being coupled between an exercise station base 312 and an exercise cable 326 within an exercise station vertical resistance frame 320. The exercise cable 326 is then routed via a plurality of pulley system 322 about the top of the exercise station vertical resistance frame 320, then along the exercise station base 312 and lower body exercise station 324 terminating at the user's foot 302. The user inserts their user's foot 302 into a foot loop 330; the foot loop 330 being fastened to the distal end of the exercise cable 326. The resistance operated exercise station 310 can utilize any configuration of pre-tensioned resistance band assembly 130 presented herein, such as the parallel arranged pre-tensioned elastic resistance assembly 150, the serially arranged pre-tensioned elastic resistance assembly 160, or any combination therein.

Figure 10:
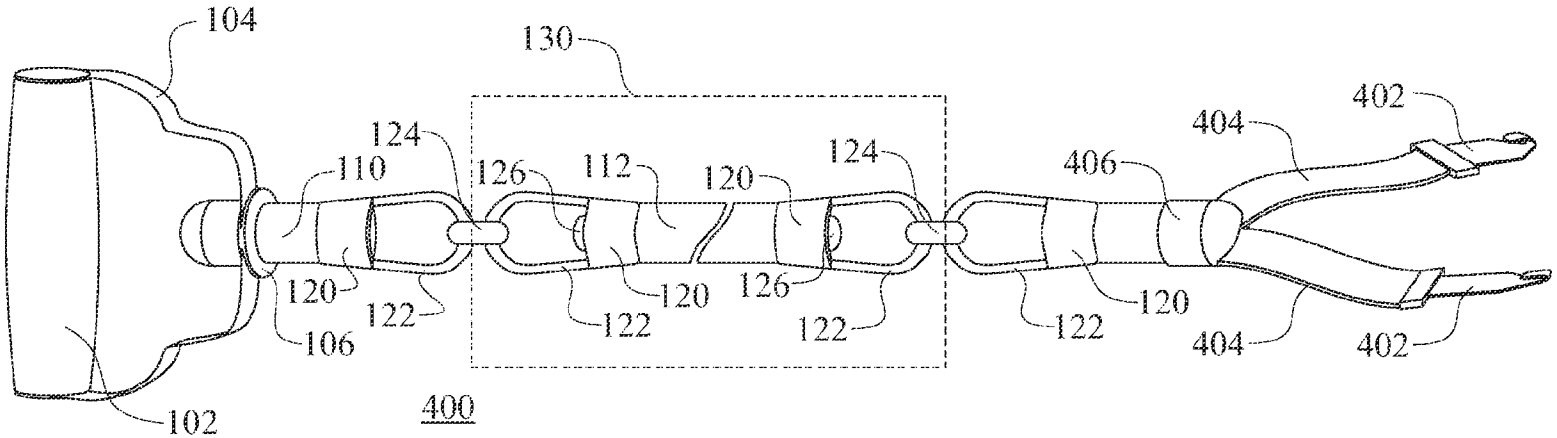
FIG. 10 presents yet another embodiment of an elastic resistance band utilizing hooks and a length adjusting strap.
Figure 11:
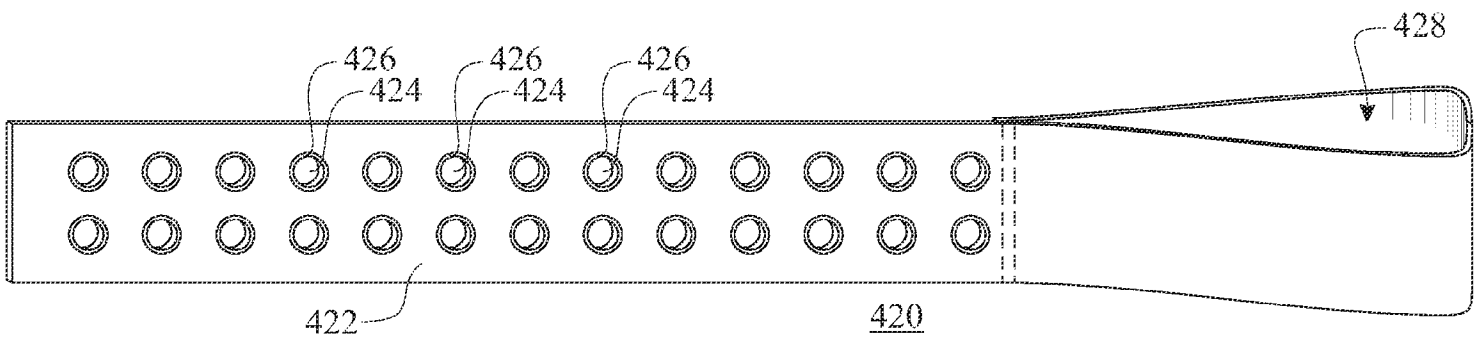
FIG. 11 presents the length adjusting strap for use with the elastic resistance band illustrated in FIG. 11.

FIG. 10 presents an additional feature of the present invention, wherein the pre-tensioned resistance band assembly 130 is incorporated into a length adjusting elastic resistance band 400. The length adjusting elastic resistance band 400 comprising the features of linear elastic resistance band 100, replacing one handle with at least one band clip(s) 402. Each band clip(s) 402 is fastened to a band clip strap(s) 404, which is secured to the end of the linear elastic resistance band 100 via a band clip coupler 406. The length adjusting elastic resistance band 400 is used in conjunction with a length adjusting strap 420 presented in FIG. 11. The length adjusting strap 420 is fabricated from a strap base material 422, incorporating a strap securing loop 428 at one end and having a plurality of strap coupling apertures 424 along the body towards the opposing end. The strap base material 422 can be of any material, including canvas, leather, nylon, and the like. The strap coupling apertures 424 can optionally be reinforced via strap aperture reinforcements 426 as desired. The band clip(s) 402 of length adjusting elastic resistance band 400 can be inserted into the strap coupling apertures 424 of length adjusting strap 420 providing the user with the ability to adjust the overall length of the exercise band. The strap securing loop 428 can include a "C" shaped cutout (not shown) for securing the end to a door handle or other object.

Figure 12:
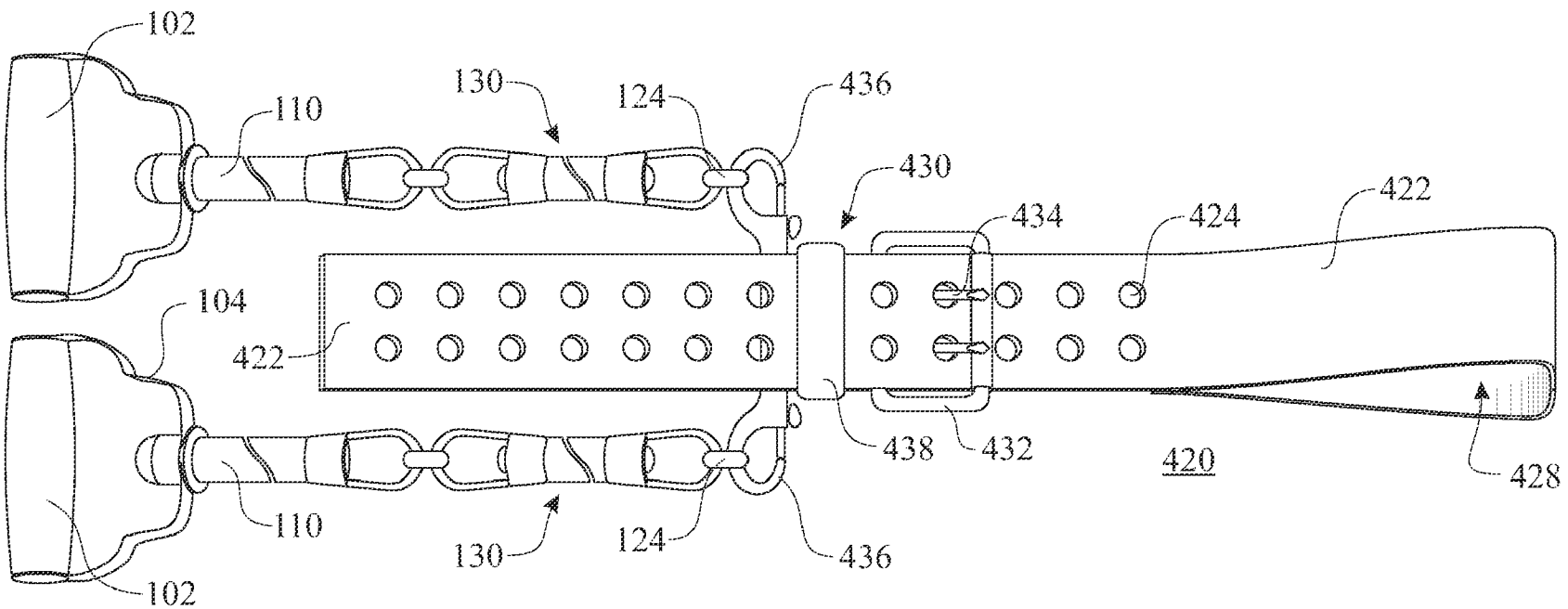
FIG. 12 presents the length adjusting strap combined with a dual resistance band coupling buckle.

FIG. 12 presents a modified connecting scheme, replacing the band clip(s) 402 with a buckle-band connecting clips 436. An adjusting strap buckle assembly 430 is utilized for coupling the pre-tensioned resistance band assembly 130 to the length adjusting strap 420. A strap loop 438 would be slid over the strap base material 422. The adjusting strap buckle assembly 430 consists of a adjusting strap buckle 432 and respective adjusting strap buckle prongs 434, wherein the adjusting strap buckle prongs 434 would be placed through the strap coupling apertures 424 affixing the adjusting strap buckle assembly 430 to the length adjusting strap 420. The buckle-band connecting clips 436 are assembled to the adjusting strap buckle assembly 430 providing a means for removably attaching the pre-tensioned resistance band assembly 130.

Figure 13:
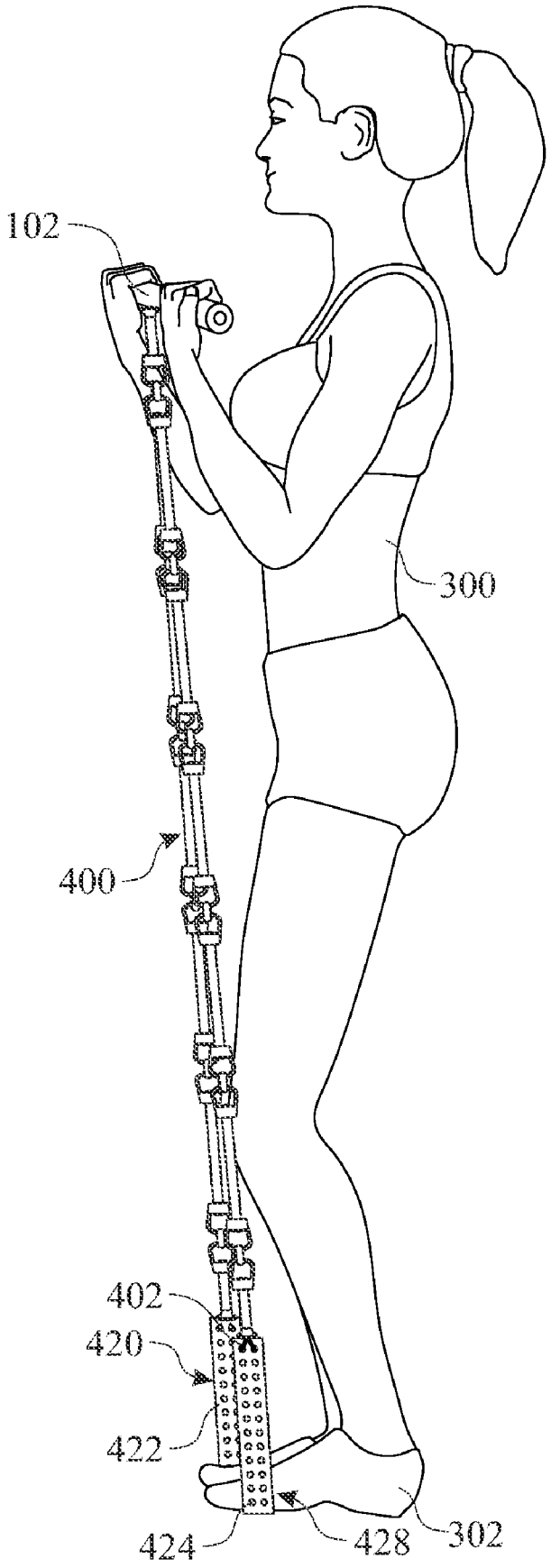
FIG. 13 presents the length adjusting strap and respective elastic resistance band configuration of FIGS. 10-12 illustrated in use.

FIG. 13 illustrates the use of the length adjusting strap 420, wherein the user 300 would secure the length adjusting elastic resistance band 400 to the length adjusting strap 420 via placing the band clip(s) 402 into the strap coupling apertures 424 setting a desiring length of the overall exercise band. The user 300 then would place their user's foot 302 into the strap securing loop 428, hold the band handle 102 and exercise accordingly.

Figure 14:
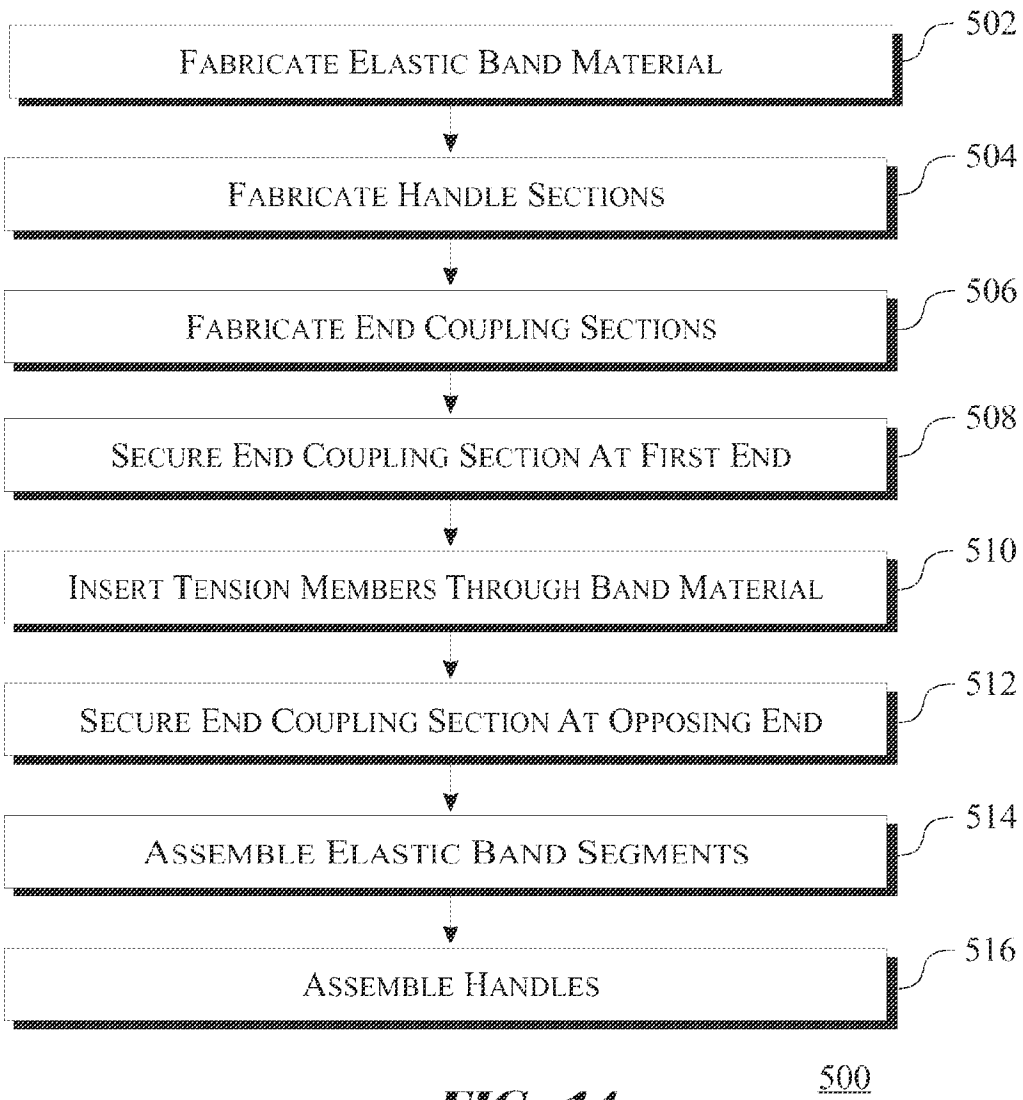
FIG. 14 presents a linear resistance band fabrication flow diagram.

FIG. 14 presents a pre-tensioned resistance band fabrication flow diagram 500. The pre-tensioned resistance band fabrication flow diagram 500 initiates with an elastic band material fabrication step 502, wherein the elastic banding material is formed and cut to length. The elastic band material can be fabricated via an extrusion process. The handle sections are fabricated in accordance with a handle fabrication step 504. The handles can be fabricated of metal, plastic, wood, and the like. The handles can be covered with a soft material such as foam, rubber, fabric, or any other cushioning material. The band coupling members are fabricated in accordance with an end coupling section fabrication step 506. The end coupling members can be fabricated via common injection molding processes. It is recognized that any form factor can be utilized, as long as the form factor meets the requirements of the design. The end coupling members provide three features: 1) securing the elastic material, 2) coupling between elastic section assemblies, and 3) receiving the pre-tensioning force. The first end coupling member is assembled to a first end of the resistance band material as presented in a secure first end coupling section step 508. The tension member is fabricated, cut to length, and assembled about the band material as described by a tension member fabrication and insertion step 510. The tension members are fabricated of a non-compressible material such as metal, plastic, and the like. The tension members can be either solid and placed within a hollowed section of the band material or hollow and placed over the band material. Once the tension member is placed into position, the elastic band is stretched, applying a pre-set tension to the band material. Another end coupling member is secured to the opposing end fixing the pre-applied tension, as presented via a second end coupling member assembly step 512.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A method for linearizing a resistance force of a resistance exercise band, the method comprising the steps:

utilizing a section of resistance material having:

a first end coupler secured to a first end of the section of elastic resistance material;

a second end coupler secured to a second end of the section of elastic resistance material;

applying a pre-tensioning force by positioning a rigid member between the first end coupler and the second end coupler to extend the section of elastic resistance material prior to use wherein the pre-tensioning force extends the section of elastic resistance material from a relaxed statue and applies a compression force to the rigid member; and removing the compression force applied to the rigid member by extending the elastic resistance material applying a linearly opposing force to each end of the section of elastic resistance material.

2. A method for linearizing a resistance force of a resistance exercise band as recited in claim 1, further comprising a step of positioning a rigid member between the first end coupler and the second end coupler to obtain the pre-tensioning force.

3. A method for linearizing a resistance force of a resistance exercise band as recited in claim 1, further comprising a step of positioning a rigid member within a tubular section of the elastic resistance material, the rigid member applying an extension force between the first end coupler and the second end coupler to obtain the pre-tensioning force.

4. A method for linearizing a resistance force of a resistance exercise band as recited in claim 1, further comprising a step of positioning the section of the elastic resistance material within a tubular rigid member, the rigid member applying an extension force between the first end coupler and the second end coupler to obtain the pre-tensioning force.

5. A method for linearizing a resistance force of a resistance exercise band as recited in claim 1, further comprising a step of increasing a length of the resistance exercise band by attaching a plurality of attaching a plurality of pre-tensioned resistance band assemblies in a serial arrangement.

6. A method for linearizing a resistance force of a resistance exercise band as recited in claim 1, further comprising a step of increasing a resistance force of the resistance exercise band by attaching a plurality of attaching a plurality of pre-tensioned resistance band assemblies in a parallel arrangement.

7. A method for linearizing a resistance force of a resistance exercise band as recited in claim 1, further comprising a step of attaching at least one end coupler to an exercise station.

8. A method for linearizing a resistance force of a resistance exercise band as recited in claim 1, further comprising a step of increasing a length of the resistance exercise band by coupling an end coupler to a length adjusting strap, the length adjusting strap comprising a series of adjusting holes.

9. A method for linearizing a resistance force of a resistance exercise band, the method comprising the steps:

utilizing a section of resistance material having:

a first end coupler secured to a first end of the section of elastic resistance material;

a second end coupler secured to a second end of the section of elastic resistance material;

applying a pre-tensioning force by positioning a rigid member between the first end coupler and the second end coupler to extend the section of elastic resistance material prior to use wherein the pre-tensioning force applies a compression force to the rigid member; and removing the compression force applied to the rigid member by extending the elastic resistance material.

10. A method for linearizing a resistance force of a resistance exercise band as recited in claim 9, further comprising a step of positioning a rigid member within a tubular section of the elastic resistance material, the rigid member applying an extension force between the first end coupler and the second end coupler to obtain the pre-tensioning force.

11. A method for linearizing a resistance force of a resistance exercise band as recited in claim 9, further comprising a step of positioning the section of the elastic resistance material within a tubular rigid member, the rigid member applying an extension force between the first end coupler and the second end coupler to obtain the pre-tensioning force.

12. A method for linearizing a resistance force of a resistance exercise band as recited in claim 9, further comprising a step of increasing a length of the resistance exercise band by attaching a plurality of attaching a plurality of pre-tensioned resistance band assemblies in a serial arrangement.

13. A method for linearizing a resistance force of a resistance exercise band as recited in claim 9, further comprising a step of increasing a resistance force of the resistance exercise band by attaching a plurality of attaching a plurality of pre-tensioned resistance band assemblies in a parallel arrangement.

14. A method for linearizing a resistance force of a resistance exercise band as recited in claim 9, further comprising a step of attaching at least one end coupler to an exercise station.

15. A method for linearizing a resistance force of a resistance exercise band as recited in claim 9, further comprising a step of attaching at least one end coupler to an exercise station.

16. A method for linearizing a resistance force of a resistance exercise band as recited in claim 9, further comprising a step of increasing a length of the resistance exercise band by coupling an end coupler to a length adjusting strap, the length adjusting strap comprising a series of adjusting holes.

17. A method for linearizing a resistance force of a resistance exercise band, the method comprising the steps:

utilizing a section of resistance material having:

a first end coupler secured to a first end of the section of elastic resistance material;

a second end coupler secured to a second end of the section of elastic resistance material;

applying a pre-tensioning force by positioning a rigid member between the first end coupler and the second end coupler to extend the section of elastic resistance material prior to use wherein the pre-tensioning force applies a compression force to the rigid member and exercising by repetitively applying and releasing a tensile force to at least one end of the removing the compression force applied to the rigid member by extending the elastic resistance material.

18. A method for linearizing a resistance force of a resistance exercise band as recited in claim 17, further comprising a step of positioning a rigid member within a tubular section of the elastic resistance material, the rigid member applying an extension force between the first end coupler and the second end coupler to obtain the pre-tensioning force.

19. A method for linearizing a resistance force of a resistance exercise band as recited in claim 17, further comprising a step of positioning a rigid member external to the elastic resistance material, the rigid member applying an extension force between the first end coupler and the second end coupler to obtain the pre-tensioning force.

20. A method for linearizing a resistance force of a resistance exercise band as recited in claim 9, further comprising a step of attaching at least one end coupler to an exercise station.

* * * * *